United States Patent [19]

Bazin et al.

[11] Patent Number: 5,051,657

[45] Date of Patent: Sep. 24, 1991

[54] SAFETY FILAMENT ASSEMBLY FOR DOUBLE-ENVELOPED ARC DISCHARGE LAMP

[75] Inventors: Simone P. Bazin, Bedford; Martin E. Muzeroll, Merrimack, both of N.H.

[73] Assignee: GTE Products Corp., Danvers, Mass.

[21] Appl. No.: 538,562

[22] Filed: Jun. 15, 1990

[51] Int. Cl.[5] ..... H01J 7/44; H01J 13/46; H01J 17/34; H01J 19/78

[52] U.S. Cl. ..... 315/73; 315/74; 315/49

[58] Field of Search ..... 315/73, 74, 49, 182, 315/179; 362/20, 21

[56] References Cited

U.S. PATENT DOCUMENTS 4,888,517 12/1989 Keefee ..... 313/25

*Primary Examiner*—Eugene R. LaRoche

*Assistant Examiner*—R. Ratliff

*Attorney, Agent, or Firm*—Joseph S. Romanow

[57] ABSTRACT

An electric lamp assembly includes a sealed outer envelope, an arc discharge tube mounted within the outer envelope, a safety filament connected in series with the arc discharge tube for extinguishing the arc tube within a predetermined time after the outer envelope is broken, and an electrically-insulating sleeve disposed around the safety filament. The insulating sleeve suppresses emission of electrons from the safety filament and thereby prevents a reduction in frame potential which would increase sodium loss from the arc tube. The insulating sleeve includes openings which permit air to reach the safety filament when the outer envelope is broken. A mounting arrangement includes a pair of mounting tabs which provide electrical connections for the safety filament and which approximately centers the safety filament in the insulating sleeve.

14 Claims, 5 Drawing Sheets

SAFETY FILAMENT ASSEMBLY FOR DOUBLE-ENVELOPED ARC DISCHARGE LAMP

CROSS REFERENCE TO RELATED APPLICATION

This application discloses, but does not claim, subject matter that is claimed in application Ser. No. 538,549 filed Jan. 15, 1990 concurrently herewith and assigned to the assignee of this application.

FIELD OF THE INVENTION

This invention relates to arc discharge lamps and, more particularly, to double enveloped arc discharge lamps which contain a low wattage safety filament that is designed to rapidly oxidize and extinguish the lamp when the outer envelope of the lamp is broken.

BACKGROUND OF THE INVENTION

High intensity arc discharge lamps such as metal halide lamps and mercury lamps typically include a quartz arc tube mounted within a glass outer envelope. In some cases, the region between the arc tube and the outer envelope is filled with an inert gas such as nitrogen, while in other cases this region is evacuated. The radiation generated by arc discharge lamps contains potentially harmful ultraviolet radiation which is blocked by the glass outer envelope.

In one failure mode, the arc tube bursts, thereby terminating emission of radiation. Various techniques have been disclosed in the prior art for containing the fragments of an arc tube which bursts, and for insuring that the outer envelope remains intact. Such techniques include the use of a thick walled outer envelope and the use of a light-transmissive shroud between the arc tube and the outer envelope.

In another failure mode, the outer envelope of the arc discharge lamp is broken by an external impact. In this case, the arc tube may continue operating and emitting potentially harmful ultraviolet radiation which is no longer blocked by the outer envelope. Frequently, arc discharge lamps are operated in enclosed fixtures which contain fragments of a shattered outer envelope and absorb ultraviolet radiation. However, in other applications, it is desirable to operate arc discharge lamps in open fixtures which are generally less expensive than enclosed fixtures and may be preferable for technical and/or aesthetic reasons.

To prevent operation of the arc tube in the event of an outer envelope failure, a low wattage, easily-oxidized safety filament is sometimes included in the lamp. The safety filament is located within the outer envelope and is electrically connected in series with the arc tube. If the outer envelope is broken, the safety filament is rapidly oxidized when it comes in contact with the oxygen in the air, thereby interrupting the electrical circuit of the arc tube and extinguishing the lamp. This technique is disclosed in European Patent Application No. 0,326,079. Techniques for extinguishing arc discharge lamps when the outer envelope is broken are also disclosed in U.S. Pat. No. 4,013,919 issued Mar. 22, 1977 to Corbley, U.S. Pat. No. 4,013,920 issued Mar. 22, 1977 to Petro, U.S. Pat. No. 4,208,614 issued June 17, 1980 to Strauss et al and U.S. Pat. No. 4,629,939 issued Dec. 16, 1986 to Jaworowicz et al.

It has been observed that the inclusion of a safety filament in a metal halide arc discharge lamp of the type disclosed in U.S. Pat. No. 4,888,517 issued Dec. 19, 1989 to Keeffe et al and containing sodium iodide and scandium iodide, considerably reduces the operating life of the lamp. The lamp disclosed in the Keeffe et al patent includes a shroud surrounding the arc tube and a frame for mechanically supporting the shroud and the arc tube. When a safety filament is included in such a lamp, excessive arc tube voltage rise and changes in the color temperature of the lamp are observed in a relatively short time. It is desirable to overcome such problems and to provide an arc discharge lamp having a safety filament for protection in the event of outer envelope breakage, and having a long operating life.

It is a general object of the present invention to provide improved arc discharge lamps.

It is another object of the present invention to provide double enveloped arc discharge lamps having a safety filament and having a long operating life.

It is a further object of the present invention to provide double-enveloped arc discharge lamps having a safety filament provided with an insulating sleeve for suppressing emission of electrons.

It is still another object of the present invention to provide arc discharge lamps wherein migration of sodium and other alkali metal ions from the arc tube is suppressed, thereby extending the operating life of the lamp.

It is a further object of the present invention to provide arc discharge lamps that are safe in the event of outer envelope breakage.

It is another object of the present invention to provide double enveloped arc discharge lamps that are extinguished within a prescribed time after the outer envelope is broken.

SUMMARY OF THE INVENTION

According to the present invention, these and other objects and advantages are achieved in an electric lamp assembly comprising a sealed outer envelope, a lamp capsule mounted within the outer envelope for generating light upon application of electrical energy, the lamp capsule containing a fill material including an alkali metal or an alkali metal compound, means for coupling electrical energy through the outer envelope to the lamp capsule, the coupling means including a safety filament mounted within the outer envelope for extinguishing the lamp capsule within a predetermined time after the outer envelope is broken and the safety filament is exposed to air, the safety filament being connected in series with the lamp capsule, an electrically insulating sleeve disposed around the safety filament, and means for mounting the safety filament in the sleeve, the mounting means including means for positioning the safety filament in the sleeve without contact between the safety filament and the sleeve.

The lamp capsule typically comprises a metal halide arc tube containing one or more sodium halides. It has been found that thermionic emission of electrons from the safety filament causes a reduction in positive potential on frame elements located within the outer envelope. The reduction in positive potential in turn permits migration of positive sodium ions through the arc tube and causes a reduction in its operating life. By suppressing emission of electrons from the safety filament, the frame elements maintain a positive potential and suppress emission of sodium ions from the arc tube.

The insulating sleeve typically comprises a generally cylindrical, open ended tube surrounding the safety filament. The open ends of the tube permit air to reach the safety filament when the outer envelope is broken. The means for positioning the safety filament in the sleeve typically comprises mounting tabs at each end of the sleeve. The safety filament is electrically and mechanically attached to the mounting tabs such that the filament is approximately centered in the sleeve. In a preferred embodiment, the mounting tabs each comprise a generally flat element having a first portion which extends into the sleeve and a second portion which remains outside the sleeve. The first portion of the mounting tab has a width that is slightly less than the inside diameter of the sleeve. The second portion of the mounting tab has a width that is at least slightly larger than the inside diameter of the sleeve. Electrical leads which provide mechanical support for the filament and the sleeve are attached to the mounting tabs. The mounting tabs permit circulation of air to the safety filament and position the safety filament relative to the insulating sleeve. The mounting arrangement provides uniform and repeatable oxidation of the filament and extinguishing of the lamp capsule within a predetermined time after the outer envelope is broken.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
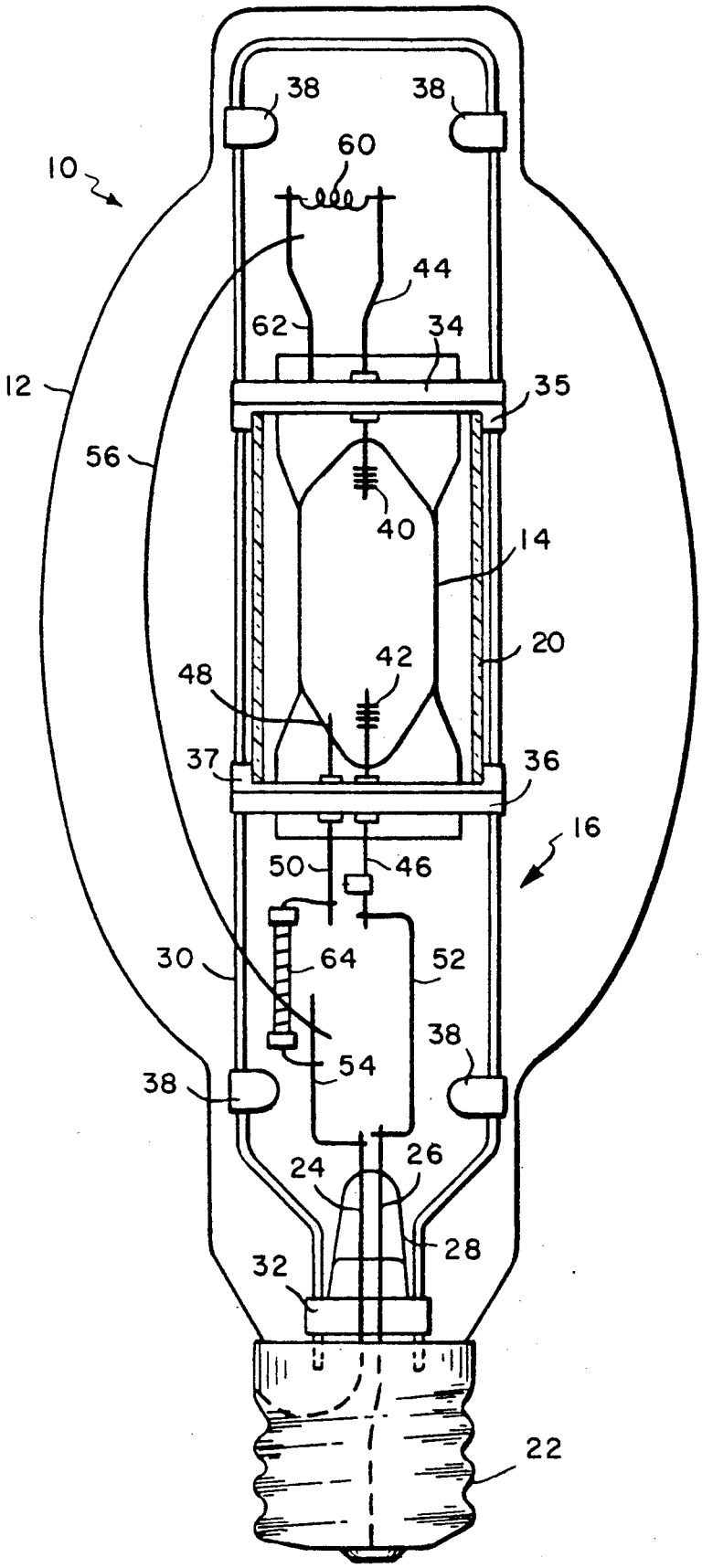
FIG. 1 PRIOR ART
FIG. 1 is a cross sectional view of a prior art metal halide arc discharge lamp with a safety filament.

A prior art metal halide arc discharge lamp assembly 10 incorporating a safety filament is shown in FIG. 1. The lamp assembly 10 includes an outer envelope 12 and an arc tube, or lamp capsule 14, mounted within outer envelope 12 by mounting means 16. The arc tube 14 is positioned within a light transmissive shroud 20, which is supported by the mounting means 16. The outer envelope 12 is sealed and is filled with an inert gas, such as nitrogen, at a pressure on the order of 300 torr to 400 torr. The outer envelope 12 may be clear or may have a phosphor coating on its inside surface. A base 22 is attached to the lower end of the outer envelope 12. Electrical leads 24 and 26 are connected to base 22 and pass through a lamp stem 28 to the interior of the outer envelope 12.

The mounting means 16 includes a generally U shaped support frame 30 attached to lamp stem 28 by a strap 32. The arc tube 14 is mechanically attached to support frame 30 by straps 34 and 36, and the shroud 20 is retained by annular ring clips 35 and 37. The mounting means 16 further includes spacers 38 which center the support frame 30 in the outer envelope 12.

Electrodes 40 and 42 are sealed in arc tube 14 and are connected through press seals at opposite ends of the arc tube 14 to inleads 44 and 46, respectively. The arc tube 14 is typically fabricated of quartz. A startinq electrode 48 adjacent to electrode 42 is connected through the press seal to an inlead 50. The arc tube 14 typically contains mercury, a starting gas and one or more metal halides including a sodium halide. Electrical lead 26 is connected to inlead 46 by an electrical lead 52. Electrical lead 24 is connected by electrical leads 54 and 56 to a first end of a safety filament 60. A second end of safety filament 60 is connected to inlead 44. The first end of safety filament 60 is supported by a dummy lead 62 in the press seal of arc tube 14 adjacent to electrode 40. Thus, the safety filament 60 is electrically connected in series with the arc tube 14. Lead 54 is connected through a resistor 64 to inlead 50 of the starting electrode 48.

During normal operation, the operating current for arc tube 14 passes through safety filament 60. In the event that the outer envelope 12 is broken, oxygen in the atmosphere causes rapid oxidation of the safety filament 60. When the safety filament 60 burns out, the continuity of the electrical circuit of the arc tube 14 is interrupted, and the arc tube 14 is extinguished. The safety filament 60 is selected to oxidize and burn through in a time of about 15 minutes or less. For a 400 watt arc tube 14, safety filament 60 typically comprises a coiled, nonsag tungsten filament that is about 6 mm in length and is made of 0.2 mm diameter wire with a coil diameter of 1 mm. The filament operates at a temperature of approximately 1300° C. and a power dissipation of 6 watts.

As indicated above, metal halide arc discharge lamps constructed as shown in FIG. 1 and described hereinabove have exhibited excessive increases in operating voltage and undesired changes in color temperature during early life as compared with similar discharge lamps not including a safety filament. The excessive increases in operating voltage and the changes in the color temperature exhibited by lamps with a safety filament are indicative of sodium loss from the arc tube 14.

The reason for the sodium loss was investigated by measuring the floating potential of the shroud 20 and the support frame 30 of 400 watt double enveloped metal halide lamps with and without the safety filament 60. Lamps having the safety filament 60 were constructed as shown in FIG. 1 and described hereinabove. Lamps not having a safety filament were constructed as shown in FIG. 1 except that the safety filament 60 was omitted and lead 56 was connected directly to inlead 44. The potential of the support frame 30 with respect to leads 52 and 56 as a function of the power applied to the lamp is shown in FIG. 1 for the case with no safety filament 60. Curve 70 shows the potential between support frame 30 and grounded lead 56, while curve 72 shows the potential between support frame 30 and high voltage lead 52. The lamp without a safety filament displays the expected result that the potential increases with increasing lamp power and approaches 100 volts near the nominal lamp operating power of A high positive frame potential is required to inhibit the sodium ions in the discharge within the arc tube 14 from drifting and diffusing through the quartz wall of the arc tube under the influence of the time dependent electric field between the arc tube 14 and the support frame 30 and shroud 20. Sodium ions which migrate through the wall of arc tube 14 are subsequently attracted to the support frame 30 where they are neutralized. The lower the frame potential, the greater will be the loss of sodium from the arc tube 14 due to the higher electric field between the arc tube 14 and the shroud 20 or support frame 30 on each positive half cycle of the applied lamp voltage.

Figure 2:
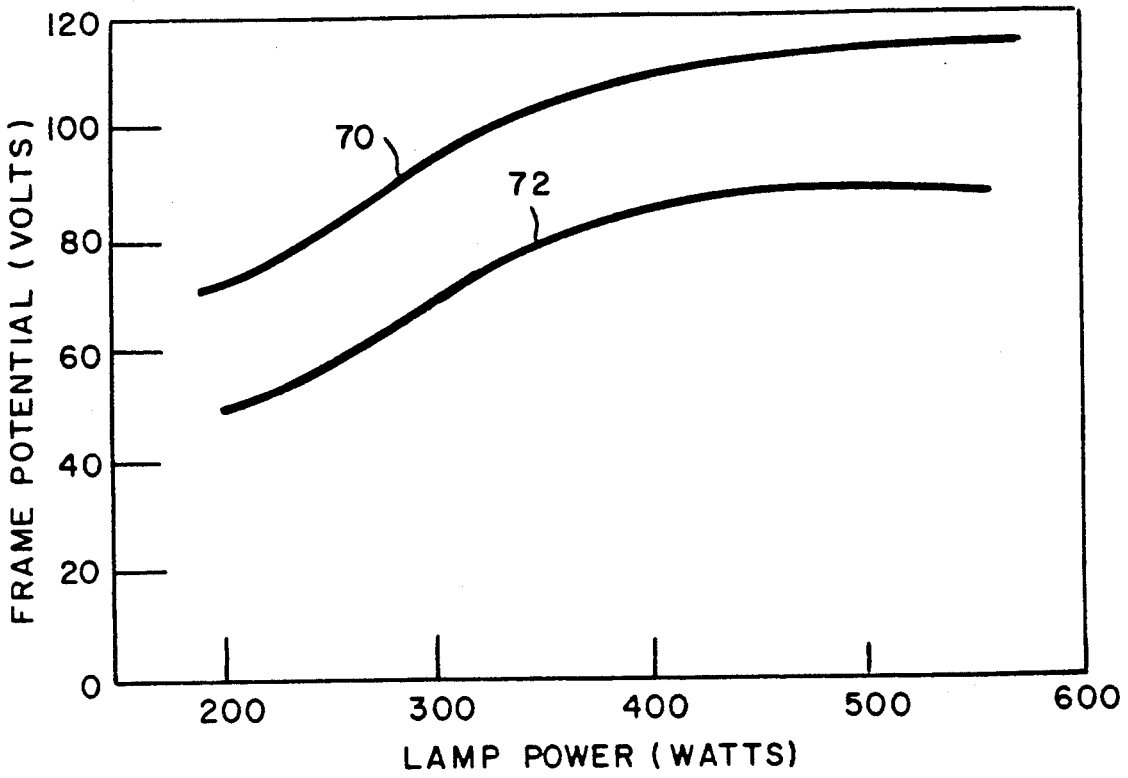
FIG. 2 is a graph of frame potential as a function of lamp power for a metal halide arc discharge lamp not utilizing a safety filament.
Figure 3:
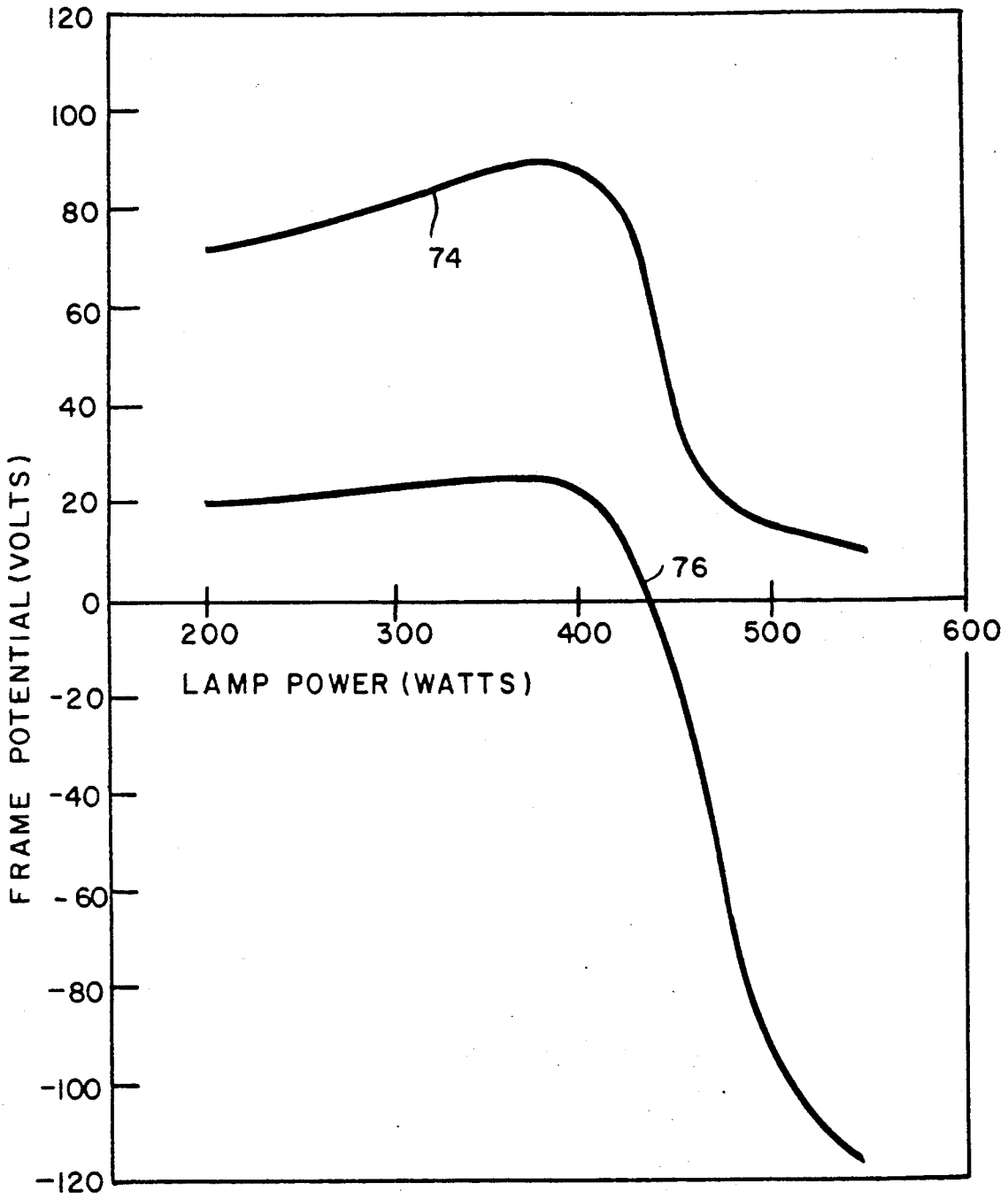
FIG. 3 is a graph of frame potential as a function of lamp power for a metal halide arc discharge lamp utilizing a safety filament as shown in FIG. 1.

The potential between the support frame 30 and the electrical leads 52 and 56 is shown in FIG. 3 for a lamp that is identical to the lamp tested in FIG. 2 except for the inclusion of a safety filament 60 as shown in FIG. 1. The potential between frame 30 and grounded lead 56 is shown by curve 74, while the potential between frame 30 and high voltage lead 52 is shown by curve 76. In this case, the potential on the support frame 30 and the shroud 20 increases with increasing lamp wattage only up to about 350 watts. At higher lamp power, the potential on the support frame 30 actually decreases with further increases in lamp wattage. The potential on the support frame 30 with respect to the high voltage lead 52 becomes negative at power levels above about 430 watts.

The reason for the result shown in FIG. 3 is that at higher lamp wattages, the temperature of the safety filament 60 is sufficiently high that the filament 60 thermionically emits electrons. The electrons are attracted to the support frame 30 on each negative half cycle of the applied lamp voltage and drive the average frame potential to a negative voltage with respect to the arc tube 14. A low positive voltage or a negative voltage on the shroud 20 and the support frame 30 with respect to the arc tube 14 causes increased sodium ion loss from the arc tube 14. As a result, the discharge voltage across the arc tube 14 increases, thereby leading to early lamp failure.

Figure 4:
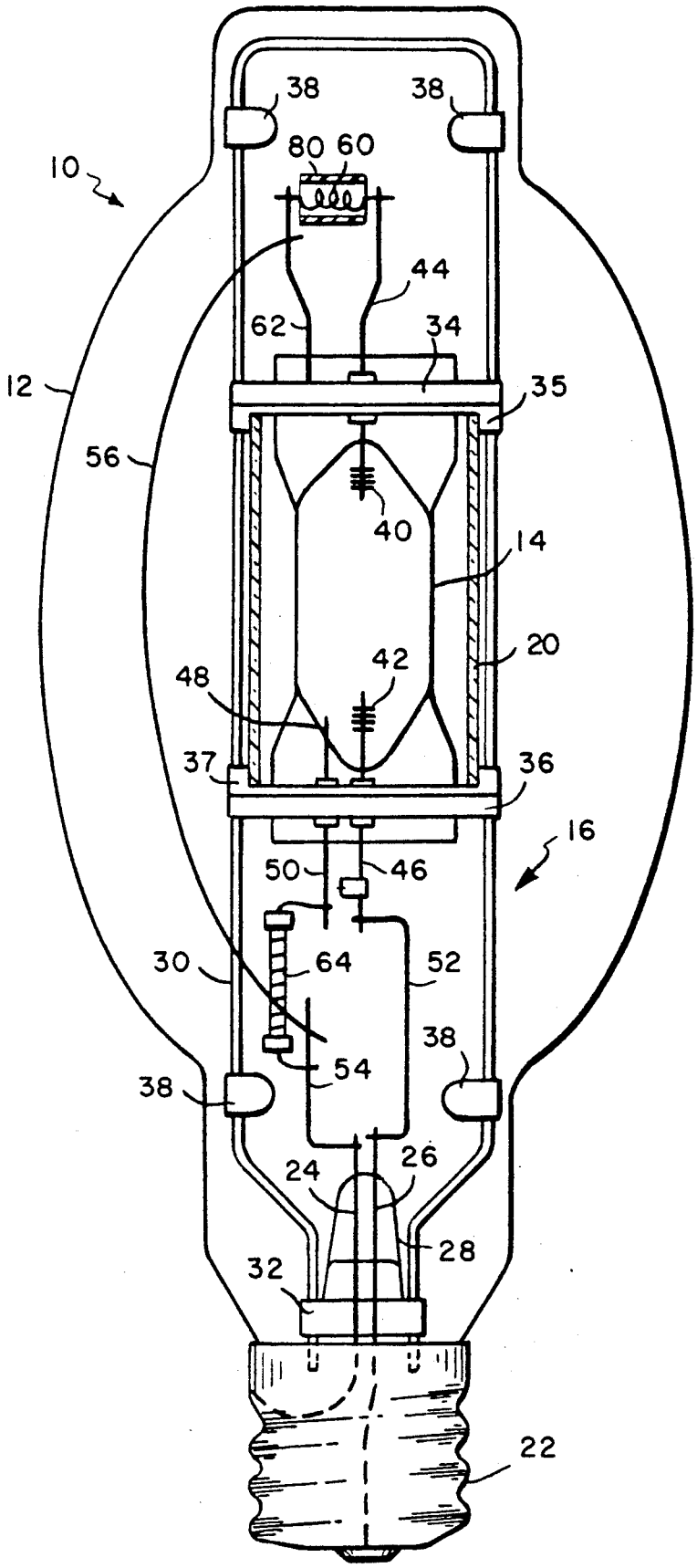
FIG. 4 is a cross sectional view of a metal halide arc discharge lamp including a safety filament with an insulating sleeve in accordance with the present invention.

The above described problem can be reduced or eliminated by inhibiting or suppressing the emission of electrons from the safety filament 60. We have found that a way to reduce and possibly eliminate the emission of electrons from the filament 60 is to enclose the filament in an insulating sleeve that is capable of withstanding the operating temperature of about 1000° C. to 1500° C. in the immediate vicinity of the filament 60. A lamp assembly in accordance with the invention is shown in FIG. 4. The lamp assembly shown in FIG. 4 is the same as the lamp assembly shown in FIG. 1 except that an insulating sleeve 80 surrounds the safety filament 60.

Figure 5:
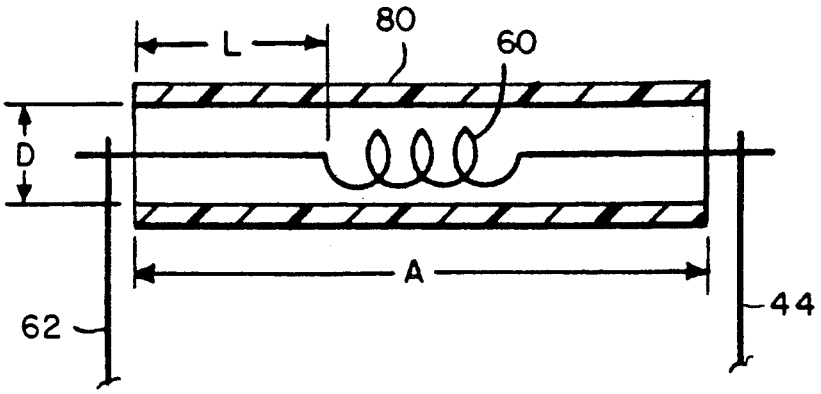
FIG. 5 is an enlarged, cross sectional view of the safety filament and insulating sleeve of FIG. 4.

As indicated above, the sleeve 60 can be fabricated of any insulating material that is able to withstand the operating temperature near the filament 60 without melting or cracking. Such materials include quartz, high temperature glasses, ceramics, alumina and boron nitride. An enlarged, cross-sectional view of the safety filament 60 and the insulating sleeve 80 is shown in FIG. 5. In a preferred embodiment, the sleeve 80 comprises a cylindrical, open ended tube. The sleeve 80 cannot be sealed and must have at least one opening of sufficient size to permit oxygen in the atmosphere to reach the filament 60 and oxidize it-within a prescribed time after the outer envelope 12 is broken. However, the sleeve 80 must sufficiently enclose the filament 60 to prevent a significant number of electrons from escaping and reaching the support frame 30 and shroud 20.

The above requirements are met by a cylindrical sleeve 80, as shown in FIG. 5, which extends beyond each end of the filament 60 by a distance L that is sufficient to prevent a significant number of electrons from escaping from the sleeve 80. However, the inside diameter D of the sleeve 80 must be large enough and the distance L short enough that oxygen from the surrounding atmosphere is able to diffuse into the sleeve 80 and oxidize the filament 60 within a prescribed time on the order of about 15 minutes or less. It is believed that the ends of the sleeve 80 which are cool relative to the central portion adjacent to filament 60 build up a negative charge and prevent electrons from escaping through the open ends of the sleeve 80. Preferably, the ratio between the distance L and the inside diameter D is in the range of about 2 to 5. By way of example, a safety filament 60 for a 400 watt metal halide lamp has a length of 6 mm, a wire diameter of 0.2 mm and a coil diameter of 1.1 mm. A suitable quartz insulating sleeve 80 has an overall length A of 15 mm, an inside diameter D of 1.9 mm and a wall thickness of 1.0 mm. In another example, a safety filament 60 for a 400 watt metal halide lamp has a length of 7 mm and a coil diameter of 1.5 mm. A suitable quartz insulating sleeve 80 has an overall length A of 27 mm, an inside diameter D of 5 mm and a wall thickness of 1.0 mm. The second example meets the above described requirements regarding the ratio between the distance L and the inside diameter D and provides more clearance between the safety filament 60 and the insulating sleeve 80. As described hereinafter, the safety filament 60 preferably does not contact the insulating sleeve 80.

Figure 6:
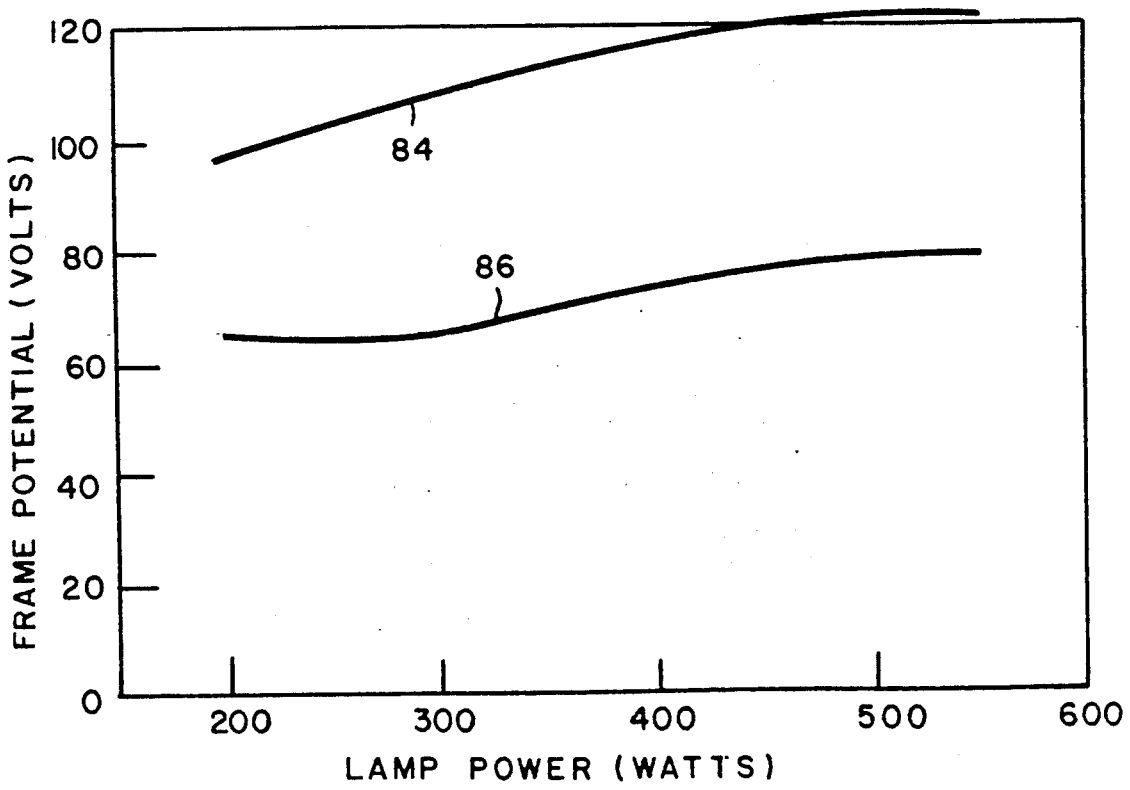
FIG. 6 is a graph of frame potential as a function of lamp power for the metal halide arc discharge lamp of FIG. 4.

The frame potential of a lamp of the type shown in FIG. 4 wherein the safety filament 60 is enclosed in a quartz sleeve 80, is shown in FIG. 6. Curve 84 shows the potential between support frame 30 and grounded lead 56, while curve 86 shows the potential between support frame 30 and high voltage lead 52. In this case, the potential on the support frame 30 and shroud 20 as a function of lamp power is very similar to that of the lamp which did not include a safety filament. The frame potential of a lamp without a safety filament is shown in FIG. 2. Thus, FIG. 6 indicates that filament emission has been considerably reduced, thereby allowing the positive frame potential to be maintained. As a consequence, the life of this lamp is expected to be similar to the life of lamps that do not include a safety filament.

The results of tests of several lamps with and without the present invention are shown in Table 1 below. In Table 1, the dimension A is the total length of the quartz sleeve 80, dimension D is the inside diameter of the quartz sleeve and L is the distance between each end of the filament 60 and the end of the quartz sleeve. These dimensions are illustrated in FIG. 5. The frame potential is the average voltage measured between the support frame 30 and the high voltage lead 52. Each of the lamps tested was a 400 watt metal halide lamp similar to a Type MP400.

TABLE 1

| LAMP NO. | A (mm) | D (mm) | L (mm) | RATIO L/D | FRAME POTENTIAL (VOLTS) |
|---|---|---|---|---|---|
| 1 | | no filament | | — | 85 |
| 2 | | no sleeve | | — | 22 |
| 3 | | no sleeve | | — | 16 |
| 4 | 15 | 1.9 | 4 | 2.1 | 73 |
| 5 | 14 | 2.4 | 3 | 1.25 | 21 |
| 6 | 16.6 | 5 | 5 | 1.0 | 46 |
| 7 | 16.6 | 5 | 5 | 1.0 | 46 |
| 8 | 16.6 | 5 | 5 | 1.0 | 22 |
| 9 | 12.5 | 1.9 | 1.5 | 0.8 | 26 |
| 10 | 12.5 | 5 | 3 | 0.6 | 41 |
| 11 | 12.5 | 5 | 3 | 0.6 | 33 |
| 12 | 12.5 | 5 | 3 | 0.6 | 33 |
| 13 | 12.5 | 5 | 3 | 0.6 | 24 |

Lamp 1 contained no safety filament. Thus, the frame potential was relatively high. Lamps 2 and 3 contained a safety filament without an insulating sleeve, as shown in FIG. 1. For lamps 2 and 3, the frame potential was a factor of about 5 or more smaller than that of lamp 1. Lamps 4–13 included a quartz sleeve having the dimensions indicated. Lamp 4 had the highest frame potential and is expected to have the longest operating life. Lamps 5–13 had L/D ratios less than 2. As a consequence, the frame potentials were a factor of 2–5 smaller than desired.

It has been found that the mounting arrangement for the safety filament and the insulating sleeve can affect operation of the safety filament. The sleeve can be loosely mounted relative to the safety filament. In this case, it is quite likely that at least a portion of the sleeve will rest against the filament. Tests of such a configuration have indicated that when the sleeve and the safety filament are in contact, heat is conducted away from the filament, and it operates at a lower temperature than when the filament and sleeve are not in contact. Thus, when the outer envelope is broken and the filament is in contact with the sleeve, the filament oxidizes slowly, and the time required for the safety filament to burn through is extended, sometimes beyond the required time for extinguishing the lamp. When the safety filament is not in contact with the sleeve, the filament burns through more rapidly.

To alleviate the above problem and to provide more uniform and predictable operation, it has been found desirable to mount the safety filament within the insulating sleeve such that it does not contact the insulating sleeve. Preferably, the safety filament is approximately centered in the insulating sleeve. The mounting arrangement must not conflict with the above described requirements that the insulating sleeve suppresses emission of electrons from the safety filament and is sufficiently open to permit oxygen in the atmosphere to reach the safety filament when the outer envelope is broken.

Figure 7:
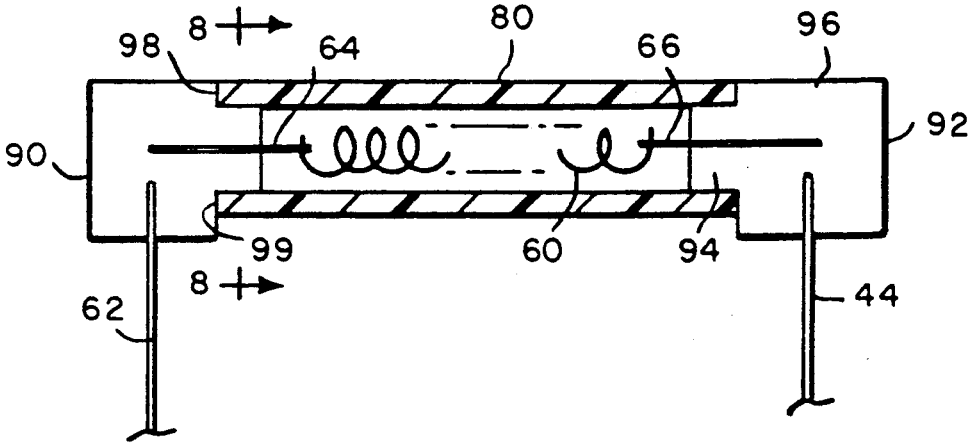
FIG. 7 is a cross sectional view of a safety filament and insulating sleeve showing a preferred mounting arrangement.
Figure 8:
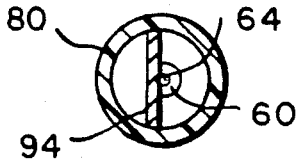
FIG. 8 is a cross sectional view, taken along the line 8 8 of FIG. 7, of the arrangement for mounting the safety filament and insulating sleeve.

A preferred mounting arrangement is shown in FIGS. 7 and 8. The assembly is mounted in the location of filament 60 and sleeve 80 shown in FIG. 4. Leads 64 and 66 of safety filament 60 are attached to mounting tabs 90 and 92, respectively, at opposite ends of insulating sleeve 80. Electrical leads 62 and 44 from arc tube 14 (see FIG. 4) are also attached to mounting tabs 90 and 92, respectively. Mounting tabs 90 and 92 position the safety filament 60 relative to the insulating sleeve 80 and also provide electrical connections to the safety filament 60.

Each of the mounting tabs 90 and 92 comprises a roughly T shaped sheet of nickel plated steel, stainless steel or other suitable conductor having a thickness of about 0.015 inch to 0.020 inch. Each of the mounting tabs 90 and 92 includes a first portion 94 having a width that is slightly smaller than the inside diameter of the sleeve 80 and a second portion 96 that is wider than the inside diameter of sleeve 80. The first portion 94 of each of the mounting tabs 90 and 92 extends into the sleeve 80, and the ends of the sleeve 80 abut against edges 98 and 99 of second portion 96. The leads 64 and 66 of the safety filament 60 are resistance welded to the mounting tabs 90 and 92, respectively, such that the safety filament 60 is approximately centered within the sleeve 80. The connecting leads 62 and 44 are also resistance-welded to the mounting tabs 90 and 92, respectively. During assembly, one lead of the safety filament 60 is welded to one of the mounting tabs 90, 92. Then, the safety filament 60 is inserted into sleeve 80 such that the end of sleeve 80 abuts against edges 98 and 99. Then, the other mounting tab is inserted into the opposite end of sleeve 80, and the other lead of the safety filament 60 is welded to the other mounting tab.

It will be understood that a variety of mounting tab configurations are included within the scope of the present invention. The requirements of the mounting tabs are that (1) the mounting tabs position the safety filament 60 relative to the sleeve 80 such that the safety filament 60 does not contact the sleeve 80, and (2) the mounting tabs permit circulation of air through the sleeve and around safety filament 60 such that the arc tube is extinguished within a prescribed time after the outer envelope is broken. Thus, for example, the first portion 94 of the mounting tabs shown in FIGS. 7 and 8 can be replaced with a ring, collar or cap that matches either the inside diameter or the outside diameter of the sleeve 80. The ring, collar or cap is attached to a flat portion to which the safety filament leads and interconnecting leads are attached. In another configuration, the mounting tabs are generally L shaped so that only one edge of the portion outside the sleeve 80 abuts against the end of the sleeve 80. The portions of the mounting tabs outside the sleeve 80 can be extended, if desired, to provide more convenient electrical and mechanical connections.

The present invention has been described in connection with metal halide arc discharge lamps containing sodium halides. It will be understood that the invention can be utilized in any arc discharge lamp in which the arc tube fill material contains an alkali metal or an alkali metal compound, and migration of alkali metal ions through the arc tube is a problem.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electric lamp assembly comprising:

a sealed outer envelope;

a lamp capsule mounted within said outer envelope for generating light upon application of electrical energy, said lamp capsule containing a fill material including an alkali metal or an alkali metal compound;

means for coupling electrical energy through said outer envelope to said lamp capsule, said coupling means including a safety filament within said outer envelope for extinguishing said lamp capsule within a predetermined time after the outer envelope is broken and the safety filament is exposed to air, said safety filament being connected in series with said lamp capsule;

an electrically insulating sleeve disposed around said safety filament; and means for mounting said safety filament and said sleeve within said outer envelope, said mounting means including means for positioning said safety filament in said sleeve without contact between said safety filament and said sleeve.

2. An electric lamp assembly said defined in claim 1 wherein said positioning means comprises mounting tabs at each end of said sleeve, said safety filament being attached to said mounting tabs.

3. An electric lamp assembly as defined in claim 1 wherein said sleeve comprises a generally cylindrical tube having open ends and wherein said positioning means comprises mounting tabs at each end of said tube, said safety filament being attached to said mounting tabs.

4. An electric lamp assembly as defined in claim 3 wherein said mounting tabs are constructed and positioned relative to said sleeve to permit air flow into said sleeve.

5. An electric lamp assembly as defined in claim 4 wherein each of said mounting tabs comprises a generally flat element having a first portion which extends into said sleeve and a second portion which remains outside said sleeve, each mounting tab being oriented parallel to the axis of said sleeve and being so positioned relative to said sleeve that the end of said sleeve rests against an edge of said second portion.

6. An electric lamp assembly as defined in claim 5 wherein said first portion of said mounting tab has a width that is slightly less than the inside diameter of said sleeve.

7. An electric lamp assembly as defined in claim 4 wherein each of said mounting tabs includes a portion for attachment to said sleeve and for positioning said mounting tab relative to said sleeve.

8. An electric lamp assembly as defined in claim 4 wherein each of said mounting tabs comprises a generally T-shaped metal member having a first portion that is slightly smaller in width than the inside diameter of said sleeve and a second portion that is at least slightly larger in width than the inside diameter of said sleeve such that said first portion extends into said sleeve and said second portion remains outside said sleeve.

9. An electric lamp assembly as defined in claim 4 wherein said mounting tabs substantially center said safety filament in said sleeve.

10. An electric lamp assembly as defined in claim 4 wherein said mounting means further includes a pair of electrical leads attached between said lamp capsule and said mounting tabs, respectively, said electrical leads providing mechanical support for said safety filament, said sleeve and said mounting tabs.

11. A metal halide arc discharge lamp assembly comprising:

a sealed, light transmissive outer envelope;

a metal halide arc tube mounted within said outer envelope for generating light, said arc tube containing a fill material including one or more sodium halides;

means for coupling electrical energy through said outer envelope to said arc tube, said coupling means including a safety filament mounted within said outer envelope for extinguishing said arc tube within a predetermined time after the outer envelope is broken and the safety filament is exposed to air, said safety filament being connected in series with said arc tube;

an electrically-insulating sleeve disposed around said safety filament; and means for mounting said sleeve and said safety filament within said outer envelope, said mounting means including a pair of mounting tabs at opposite ends of said sleeve for positioning said safety filament relative to said sleeve without contact between said safety filament and said sleeve, said safety filament being electrically and mechanically connected to said mounting tabs.

12. A lamp assembly as defined in claim 11 wherein said mounting tabs are constructed and positioned relative to said sleeve to permit air flow into said sleeve.

13. A lamp assembly as defined in claim 12 wherein each of said mounting tabs comprises a generally T-shaped metal member having a first portion that is slightly smaller in width than the inside diameter of said sleeve and a second portion that is at least slightly larger in width than the inside diameter of said sleeve such that said first portion extends into said sleeve and said second portion remains outside said sleeve.

14. A lamp assembly as defined in claim 12 wherein said mounting tabs substantially center said safety filament in said sleeve.

* * * * *